US009440435B2

(12) United States Patent
Yuda

(10) Patent No.: US 9,440,435 B2
(45) Date of Patent: Sep. 13, 2016

(54) LIQUID DISCHARGE CONTROL APPARATUS AND LIQUID DISCHARGE CONTROL METHOD

(71) Applicant: Seiko Epson Corporation, Tokyo (JP)

(72) Inventor: Tomohiro Yuda, Minowa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/680,483

(22) Filed: Apr. 7, 2015

(65) Prior Publication Data

US 2015/0283805 A1 Oct. 8, 2015

(30) Foreign Application Priority Data

Apr. 8, 2014 (JP) ..... 2014-079149

(51) Int. Cl.
*B41J 2/045* (2006.01)
*B41J 2/205* (2006.01)
*B41J 2/21* (2006.01)

(52) U.S. Cl.
CPC ..... *B41J 2/04586* (2013.01); *B41J 2/2054* (2013.01); *B41J 2/2132* (2013.01); *B41J 2/2139* (2013.01)

(58) Field of Classification Search
CPC .... B41J 29/38; B41J 2/0451; B41J 2/04586; B41J 2/2054; B41J 2/2132
See application file for complete search history.

(56) References Cited

U.S. PATENT DOCUMENTS

2009/0015616 A1* 1/2009 Miyamoto ..... B41J 2/2139 347/14
2014/0176966 A1* 6/2014 Kuno ..... G06K 15/105 358/1.8

FOREIGN PATENT DOCUMENTS

JP 08-187881 A 7/1996
JP 2002-144549 A 5/2002
JP 2013-126776 A 6/2013

* cited by examiner

*Primary Examiner* — Sarah Al Hashimi
(74) *Attorney, Agent, or Firm* — Harness, Dickey & Pierce, P.L.C.

(57) ABSTRACT

A liquid discharge control apparatus includes a discharge control unit that controls the discharge of the liquid through the nozzle. In the case that the discharge control unit allocates, to a first nozzle, the pixel of a first ratio in a pixel column that represents one raster line, and allocates, to a second nozzle, the pixel of a second ratio in the pixel column, and in the case that one nozzle of the first nozzle and the second nozzle is an abnormal nozzle, and the ratio of the pixel in the pixel column allocated to the one nozzle is more than or equal to a predetermined ratio with respect to a total of the first ratio and the second ratio, the discharge control unit increases the ratio of the pixel in the pixel column allocated to the other nozzle of the first nozzle and the second nozzle.

6 Claims, 8 Drawing Sheets

IM

| | X = 1 | 2 | 3 | 4 | 5 | 6 | 7 | 8 | 9 | 10 ··· |
|---|---|---|---|---|---|---|---|---|---|---|
| Y = 1 | 2/3 | 5/1 | 5/1 | 5/1 | 2/3 | 5/1 | 5/1 | 5/1 | 5/1 | 5/1 |
| 2 | 4/2 | 1/4 | 1/4 | 1/4 | 1/4 | 1/4 | 1/4 | 1/4 | 1/4 | 1/4 |
| 3 | 3/3 | 6/1 | 3/3 | 6/1 | 3/3 | 6/1 | 6/1 | 3/3 | 6/1 | 6/1 |
| 4 | 2/4 | 5/2 | 5/2 | 5/2 | 2/4 | 5/2 | 5/2 | 5/2 | 5/2 | 5/2 |
| 5 | 4/3 | 7/1 | 7/1 | 7/1 | 7/1 | 7/1 | 7/1 | 7/1 | 7/1 | 7/1 |
| 6 | 3/4 | 6/2 | 3/4 | 6/2 | 3/4 | 6/2 | 6/2 | 3/4 | 6/2 | 6/2 |
| 7 | 8/1 | 5/3 | 5/3 | 5/3 | 8/1 | 5/3 | 5/3 | 5/3 | 5/3 | 5/3 |
| 8 | 4/4 | 7/2 | 7/2 | 7/2 | 7/2 | 7/2 | 7/2 | 7/2 | 7/2 | 7/2 |
| 9 | 9/1 | 6/3 | 9/1 | 6/3 | 9/1 | 6/3 | 6/3 | 9/1 | 6/3 | 6/3 |
| 10 | 8/2 | 5/4 | 5/4 | 5/4 | 8/2 | 5/4 | 5/4 | 5/4 | 5/4 | 5/4 |
| 11 | 10/1 | 7/3 | 7/3 | 7/3 | 7/3 | 7/3 | 7/3 | 7/3 | 7/3 | 7/3 |
| 12 | 9/2 | 6/4 | 9/2 | 6/4 | 9/2 | 6/4 | 6/4 | 9/2 | 6/4 | 6/4 |
| ⋮ | | | | | | | | | | |

FIG. 5

NOZZLE USAGE RATE DEFINING MASK 16A

| | 1 | 2 | 3 | 4 | 5 | 6 | 7 | 8 | 9 | 10 |
|---|---|---|---|---|---|---|---|---|---|---|
| 10% | 1 | 0 | 0 | 0 | 0 | 0 | 0 | 0 | 0 | 0 |
| 20% | 1 | 0 | 0 | 0 | 1 | 0 | 0 | 0 | 0 | 0 |
| 30% | 1 | 0 | 1 | 0 | 1 | 0 | 0 | 0 | 0 | 0 |
| 40% | 1 | 0 | 1 | 0 | 1 | 0 | 0 | 1 | 0 | 0 |
| 50% | 1 | 0 | 1 | 0 | 1 | 0 | 1 | 0 | 1 | 0 |
| 60% | 0 | 1 | 0 | 1 | 0 | 1 | 1 | 0 | 1 | 1 |
| 70% | 0 | 1 | 0 | 1 | 0 | 1 | 1 | 1 | 1 | 1 |
| 80% | 0 | 1 | 1 | 1 | 0 | 1 | 1 | 1 | 1 | 1 |
| 90% | 0 | 1 | 1 | 1 | 1 | 1 | 1 | 1 | 1 | 1 |
| 100% | 1 | 1 | 1 | 1 | 1 | 1 | 1 | 1 | 1 | 1 |

FIG. 6A

IM

| | X = 1 | 2 | 3 | 4 | 5 | 6 | 7 | 8 | 9 | 10 ··· |
|---|---|---|---|---|---|---|---|---|---|---|
| Y = 1 | 2/3 | 5/1 | 5/1 | 5/1 | 2/3 | 5/1 | 5/1 | 5/1 | 5/1 | 5/1 |
| 2 | 4/2 | 1/4 | 1/4 | 1/4 | 1/4 | 1/4 | 1/4 | 1/4 | 1/4 | 1/4 |
| 3 | 6/1 | 3/3 | 6/1 | 3/3 | 6/1 | 3/3 | 3/3 | 6/1 | 3/3 | 3/3 |
| 4 | 2/4 | 5/2 | 5/2 | 5/2 | 2/4 | 5/2 | 5/2 | 5/2 | 5/2 | 5/2 |
| 5 | 4/3 | 7/1 | 7/1 | 7/1 | 7/1 | 7/1 | 7/1 | 7/1 | 7/1 | 7/1 |
| 6 | 6/2 | 3/4 | 6/2 | 3/4 | 6/2 | 3/4 | 3/4 | 6/2 | 3/4 | 3/4 |
| 7 | 8/1 | 5/3 | 5/3 | 5/3 | 8/1 | 5/3 | 5/3 | 5/3 | 5/3 | 5/3 |
| 8 | 4/4 | 7/2 | 7/2 | 7/2 | 7/2 | 7/2 | 7/2 | 7/2 | 7/2 | 7/2 |
| 9 | 6/3 | 9/1 | 6/3 | 9/1 | 6/3 | 9/1 | 9/1 | 6/3 | 9/1 | 9/1 |
| 10 | 8/2 | 5/4 | 5/4 | 5/4 | 8/2 | 5/4 | 5/4 | 5/4 | 5/4 | 5/4 |
| 11 | 10/1 | 7/3 | 7/3 | 7/3 | 7/3 | 7/3 | 7/3 | 7/3 | 7/3 | 7/3 |
| 12 | 6/4 | 9/2 | 6/4 | 9/2 | 6/4 | 9/2 | 9/2 | 6/4 | 9/2 | 9/2 |
| ⋮ | | | | | | | | | | |

FIG. 6B

IM

| | X = 1 | 2 | 3 | 4 | 5 | 6 | 7 | 8 | 9 | 10 ··· |
|---|---|---|---|---|---|---|---|---|---|---|
| Y = 1 | 2/3 | 5/1 | 5/1 | 5/1 | 2/3 | 5/1 | 5/1 | 5/1 | 5/1 | 5/1 |
| 2 | 4/2 | 1/4 | 1/4 | 1/4 | 1/4 | 1/4 | 1/4 | 1/4 | 1/4 | 1/4 |
| 3 | 6/1 | 3/3 | 3/3 | 3/3 | 6/1 | 3/3 | 3/3 | 3/3 | 3/3 | 3/3 |
| 4 | 2/4 | 5/2 | 5/2 | 5/2 | 2/4 | 5/2 | 5/2 | 5/2 | 5/2 | 5/2 |
| 5 | 4/3 | 7/1 | 7/1 | 7/1 | 7/1 | 7/1 | 7/1 | 7/1 | 7/1 | 7/1 |
| 6 | 6/2 | 3/4 | 3/4 | 3/4 | 6/2 | 3/4 | 3/4 | 3/4 | 3/4 | 3/4 |
| 7 | 8/1 | 5/3 | 5/3 | 5/3 | 8/1 | 5/3 | 5/3 | 5/3 | 5/3 | 5/3 |
| 8 | 4/4 | 7/2 | 7/2 | 7/2 | 7/2 | 7/2 | 7/2 | 7/2 | 7/2 | 7/2 |
| 9 | 6/3 | 9/1 | 9/1 | 9/1 | 6/3 | 9/1 | 9/1 | 9/1 | 9/1 | 9/1 |
| 10 | 8/2 | 5/4 | 5/4 | 5/4 | 8/2 | 5/4 | 5/4 | 5/4 | 5/4 | 5/4 |
| 11 | 10/1 | 7/3 | 7/3 | 7/3 | 7/3 | 7/3 | 7/3 | 7/3 | 7/3 | 7/3 |
| 12 | 6/4 | 9/2 | 9/2 | 9/2 | 6/4 | 9/2 | 9/2 | 9/2 | 9/2 | 9/2 |
| ⋮ | | | | | | | | | | |

IM

| | X = 1 | 2 | 3 | 4 | 5 | 6 | 7 | 8 | 9 | 10 | 11 | 12 | 13 ··· |
|---|---|---|---|---|---|---|---|---|---|---|---|---|---|
| Y = 1 | 11/1 | 2/7 | 5/5 | 8/3 | 5/5 | 8/3 | 5/5 | 8/3 | 11/1 | 2/7 | 5/5 | 8/3 | 5/5 |
| 2 | 1/8 | 10/2 | 7/4 | 4/6 | 7/4 | 10/2 | 7/4 | 4/6 | 7/4 | 10/2 | 7/4 | 4/6 | 7/4 |
| 3 | 12/1 | 3/7 | 6/5 | 9/3 | 6/5 | 3/7 | 6/5 | 9/3 | 6/5 | 3/7 | 6/5 | 9/3 | 6/5 |
| 4 | 2/8 | 11/2 | 8/4 | 5/6 | 8/4 | 5/6 | 8/4 | 5/6 | 2/8 | 11/2 | 8/4 | 5/6 | 8/4 |
| 5 | 1/9 | 10/3 | 7/5 | 4/7 | 7/5 | 10/3 | 7/5 | 4/7 | 7/5 | 10/3 | 7/5 | 4/7 | 7/5 |
| 6 | 3/8 | 12/2 | 9/4 | 6/6 | 3/8 | 6/6 | 9/4 | 6/6 | 3/8 | 6/6 | 9/4 | 6/6 | 9/4 |
| ⋮ | | | | | | | | | | | | | |

FIG. 8A

IM

| | X = 1 | 2 | 3 | 4 | 5 | 6 | 7 | 8 | 9 | 10 | 11 | 12 | 13 | ··· |
|---|---|---|---|---|---|---|---|---|---|---|---|---|---|---|
| Y = 1 | 11/1 | 8/3 | 5/5 | 2/7 | 5/5 | 2/7 | 5/5 | 2/7 | 11/1 | 8/3 | 5/5 | 2/7 | 5/5 | |
| 2 | 1/8 | 10/2 | 7/4 | 4/6 | 7/4 | 10/2 | 7/4 | 4/6 | 7/4 | 10/2 | 7/4 | 4/6 | 7/4 | |
| 3 | 12/1 | 3/7 | 6/5 | 9/3 | 6/5 | 3/7 | 6/5 | 9/3 | 6/5 | 3/7 | 6/5 | 9/3 | 6/5 | |
| 4 | 8/4 | 11/2 | 2/8 | 5/6 | 2/8 | 5/6 | 2/8 | 5/6 | 8/4 | 11/2 | 2/8 | 5/6 | 2/8 | |
| 5 | 1/9 | 10/3 | 7/5 | 4/7 | 7/5 | 10/3 | 7/5 | 4/7 | 7/5 | 10/3 | 7/5 | 4/7 | 7/5 | |
| 6 | 3/8 | 12/2 | 9/4 | 6/6 | 3/8 | 6/6 | 9/4 | 6/6 | 3/8 | 6/6 | 9/4 | 6/6 | 9/4 | |
| ⋮ | | | | | | | | | | | | | | |

FIG. 8B

IM

| | X = 1 | 2 | 3 | 4 | 5 | 6 | 7 | 8 | 9 | 10 | 11 | 12 | 13 | ··· |
|---|---|---|---|---|---|---|---|---|---|---|---|---|---|---|
| Y = 1 | 11/1 | 8/3 | 5/5 | 2/7 | 5/5 | 2/7 | 5/5 | 2/7 | 11/1 | 2/7 | 5/5 | 2/7 | 5/5 | |
| 2 | 1/8 | 10/2 | 7/4 | 4/6 | 7/4 | 10/2 | 7/4 | 4/6 | 7/4 | 10/2 | 7/4 | 4/6 | 7/4 | |
| 3 | 12/1 | 3/7 | 6/5 | 9/3 | 6/5 | 3/7 | 6/5 | 9/3 | 6/5 | 3/7 | 6/5 | 9/3 | 6/5 | |
| 4 | 8/4 | 11/2 | 2/8 | 5/6 | 2/8 | 5/6 | 2/8 | 5/6 | 2/8 | 11/2 | 2/8 | 5/6 | 2/8 | |
| 5 | 1/9 | 10/3 | 7/5 | 4/7 | 7/5 | 10/3 | 7/5 | 4/7 | 7/5 | 10/3 | 7/5 | 4/7 | 7/5 | |
| 6 | 3/8 | 12/2 | 9/4 | 6/6 | 3/8 | 6/6 | 9/4 | 6/6 | 3/8 | 6/6 | 9/4 | 6/6 | 9/4 | |
| ⋮ | | | | | | | | | | | | | | |

LIQUID DISCHARGE CONTROL APPARATUS AND LIQUID DISCHARGE CONTROL METHOD

CROSS-REFERENCE TO RELATED APPLICATIONS

This application claims priority to Japanese Patent Application No. 2014-079149 filed on Apr. 8, 2014. The entire disclosure of Japanese Patent Application No. 2014-079149 is hereby incorporated herein by reference.

BACKGROUND

1. Technical Field

The present invention relates to a liquid discharge control apparatus and a liquid discharge control method.

2. Related Art

An ink jet printer includes a print head which is provided with a plurality of nozzles for discharging ink. In such a print head, clogging in some of the nozzles is likely to take place due to factors such as increasing of ink viscosity, mixing of bubbles and attaching of dust or paper powder. The clogging of the nozzle (discharge abnormality) generates dot omissions (a kind of degradation relating with a quality of image) due to a phenomenon in which the ink to be discharged is actually not discharged on the recording media.

As a related art, an ink jet printer is known in which the dot discharge not performed by defective nozzles among a plurality of nozzles provided in the print head is performed by another nozzle instead (see JP-A-2002-144549).

It is necessary to prevent the degradation of quality of image in which the dot omission described above can be exposed to view.

As described in JP-A-2002-144549, the dot discharge to be performed by a defective nozzle can be performed by another nozzle instead to resultantly remove the dot omission.

In addition, overlap printing is known in which the recording operation is performed using a plurality of nozzles (plural times of passages which the print head performs) for each raster line for forming the image to be recorded. According to the overlap printing, since the ink is discharged through a plurality of nozzles to record one raster line on the recording media, an effect which the ink discharge performed by one nozzle has on the result of the recording (quality of image) may be spread over the entire raster lines. For this reason, compared with a case in which the raster line is recorded through one nozzle (one time of passage of a print head), the overlap printing may provide an improved quality of image for example, an effect in which the positional shift of the dot caused by transport error of the recording media is not explicitly exposed to view. Further, if the entire dot discharge to be performed by the defective nozzle is performed by another nozzle instead, the dot omission does not occur in the overlap printing.

In view of the above consideration, since the degradation of the quality of image due to the dot omission and the degradation of the quality of image due to the excessive use of the same nozzle as that at the time of recording the raster line may be suppressed with good balance, the quality of image can be entirely improved.

SUMMARY

An advantage of some aspects of the invention provides a liquid discharge control apparatus and a liquid discharge control method which can usefully improve the quality of image in the case that an abnormality takes place in the discharge of nozzles.

According to an aspect of the invention, there is provided a liquid discharge control apparatus that moves a liquid discharge head having a plurality of nozzles in a predetermined direction, and discharges liquid from the nozzle. The liquid discharge control apparatus includes a discharge control unit that controls the discharge of the liquid through the nozzle, by allocating, to the nozzle, pixels which define a discharge or a non-discharge of the liquid. In the case that the discharge control unit allocates, to a first nozzle, the pixel of a first ratio in a pixel column that represents one raster line parallel to the predetermined direction, and allocates, to a second nozzle, the pixel of a second ratio in the pixel column, to use a plurality of nozzles which include at least the first nozzle and the second nozzle and record the raster line on recording media, and in the case that one nozzle of the first nozzle and the second nozzle is an abnormal nozzle that has abnormality in the discharge of liquid, and the ratio of the pixel in the pixel column allocated to the one nozzle is more than or equal to a predetermined ratio with respect to a total of the first ratio and the second ratio, the control unit increases the ratio of the pixel in the pixel column allocated to the other nozzle of the first nozzle and the second nozzle.

According to this configuration, in the case of using a plurality of nozzles which include at least the first nozzle and the second nozzle and record one raster line on recording media, and in the case that one nozzle of the first nozzle and the second nozzle is an abnormal nozzle, and the ratio of the pixel in the pixel column allocated to the one nozzle is more than or equal to the predetermined ratio, the discharge control unit increases the ratio of the pixel in the pixel column allocated to the other nozzle of the first nozzle and the second nozzle. Accordingly, it is possible to appropriately solve the problem that many dot omissions occur to the extent of being exposed to view when the dot omission is caused by the abnormal nozzle in which discharge abnormality such as clogging of the nozzle and the like is found. Further, in the case of few dot omissions which are likely to be hardly exposed to view, this dot omission is not intentionally resolved to resultantly avoid a degradation of quality of image which may be caused by excessively repeated usage of the same nozzle. Accordingly, it is possible to entirely improve the quality of image in the case that the discharge abnormality takes place in the nozzle.

It is preferable that the discharge control unit changes the first ratio and the second ratio with each other to increase the ratio of the pixel allocated to the other nozzle.

According to this configuration, the processing of increasing the ratio of the pixel allocated to the other nozzle can be simply performed.

It is preferable that the higher a permeability of liquid of the recording media is, the higher the discharge control unit increases the predetermined ratio.

According to this configuration, since a value of the predetermined ratio is optimized according to the degree of the permeability of liquid that the recording media may have, it is possible to improve the quality of image in the case that the discharge abnormality takes place in the nozzle, and even in any type of the recording media.

It is preferable that the liquid discharge head can discharge, as the liquid, at least a first ink and a second ink of which density is higher than that of the first ink, and the discharge control unit sets the predetermined ratio used in the case that the first nozzle and the second nozzle are nozzles which discharge the first ink, to a value which is higher than the predetermined ratio used in the case that the first nozzle and the second nozzle are nozzles which discharge the second ink.

According to this configuration, in the case of the first ink by which the dot omission is hardly exposed to view in spite of the existence of the dot omission, a process for resolving a failure which may occur due to the excessively repeated usage of the same nozzle is performed as a relative priority, rather than a process for resolving the dot omission. Whereas, in the case of the second ink by which the dot omission is easily exposed to view under the existence of the dot omission, the process for resolving the dot omission is performed as a relative priority, rather than the process for resolving the failure which may occur due to the excessively repeated usage of the same nozzle.

It is preferable that the discharge control unit selectively performs a first mode and a second mode, the first mode being a mode in which the ratio of the pixel allocated to the other nozzle is increased in the case that the one nozzle is the abnormal nozzle and the ratio of the pixel allocated to the one nozzle is more than or equal to the predetermined ratio with respect to a total of the first ratio and the second ratio, the second mode being a mode in which the ratio of the pixel allocated to the other nozzle is not changed regardless of whether or not the one nozzle is the abnormal nozzle, and the discharge control unit selects one of the first mode and the second mode according to types of images which include the pixel column.

According to this configuration, since the discharge control unit selects one of the first mode and the second mode according to types of images, in view of a characteristic of image, the first mode is performed in the case that the resolving of the dot omission can contribute to the improvement for quality of image.

It is preferable that the more the number of the nozzles which is used to record one raster line increases, the higher the discharge control unit increases the predetermined ratio.

According to this configuration, it is possible to properly solve the problem that the dot omissions occur to be exposed to view when the dot omission is caused by the abnormal nozzle in which discharge abnormality is found.

The technical ideals of the invention is not necessarily realized by only the liquid discharge control apparatus as described above. For example, it is possible to consider the liquid discharge control method including processes performed by each unit of the liquid discharge control apparatus as one invention. Further, the invention may be realized by various types of categories such as computer programs for executing each process of the method with hardware (a computer), readable storage media for storing the programs and the like.

BRIEF DESCRIPTION OF THE DRAWINGS

The invention will be described with reference to the accompanying drawings, wherein like numbers reference like elements.

FIG. 5 is a view showing an example of a nozzle usage rate defining mask.

FIG. 6A and FIG. 6B are views showing image data which include pixels in an abnormal nozzle corresponding pixel column allocated to the nozzles according to post-change usage rate of nozzle in the first embodiment.

FIG. 8A and FIG. 8B are views showing image data which include pixels in an abnormal nozzle corresponding pixel column allocated to the nozzles according to post-change usage rate of nozzles in the second embodiment.

DESCRIPTION OF EXEMPLARY EMBODIMENTS

The embodiments of the invention will be described in the following order.

1. Brief description of the apparatus configuration
2. First embodiment
3. Second embodiment
4. Modification examples

1. Brief Description of the Apparatus Configuration

Figure 1:
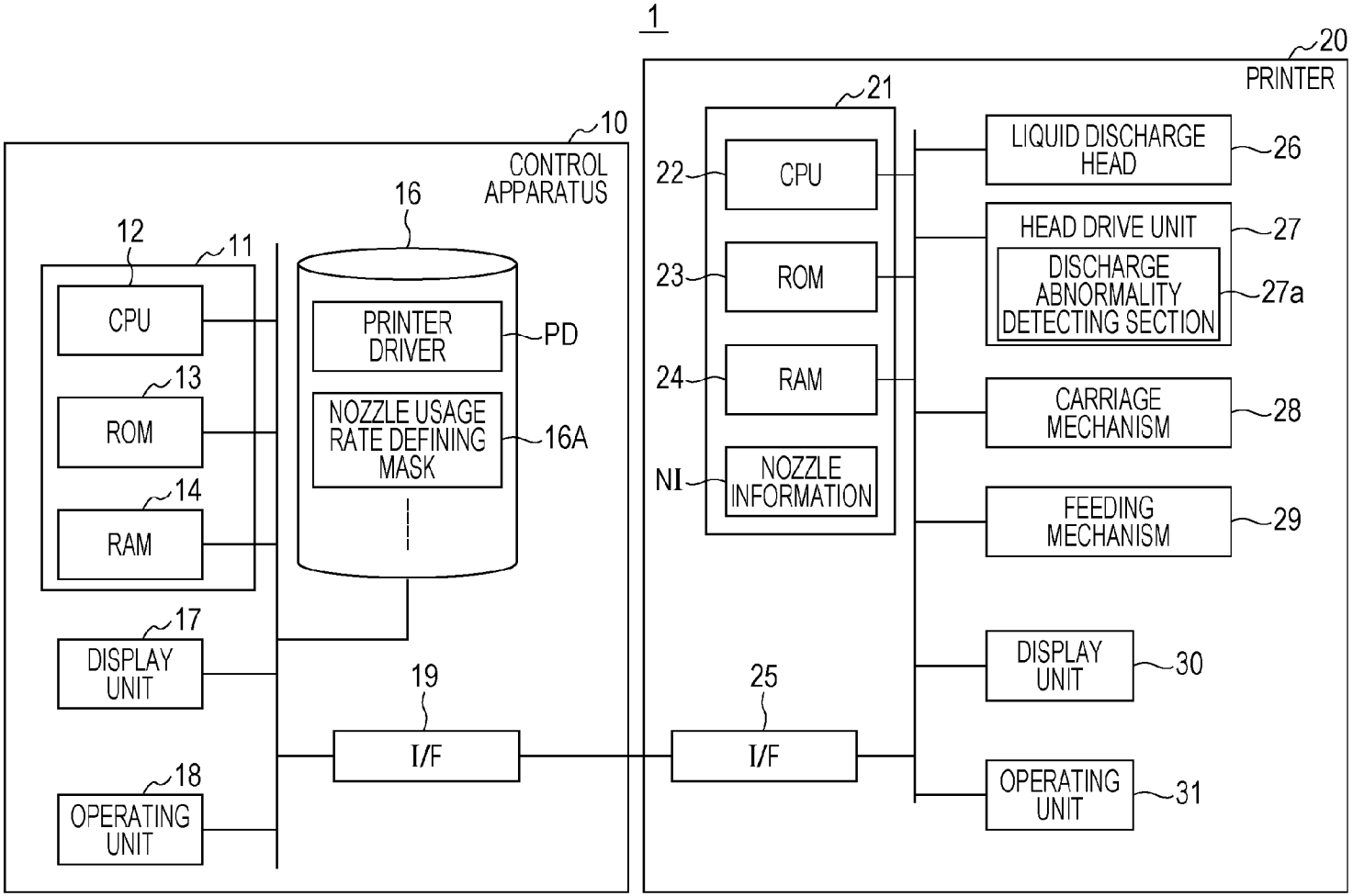
FIG. 1 is a schematic view showing a configuration of an apparatus according to an embodiment of the invention.

FIG. 1 is a schematic view showing a configuration of a liquid discharge control system 1 according to the embodiment. The liquid discharge control system 1 includes a printer 20 and a liquid discharge control apparatus (control apparatus 10) that controls the printer 20. As a main entity performing the liquid discharge control method, the control apparatus 10 is provided with a program that controls the printer 20. The control apparatus 10 is typically a personal computer (PC) of a desktop type or a tablet type. The control apparatus 10, however, may be a terminal of laptop type, a portable terminal, or the like.

Alternatively, the control apparatus 10 constituting the liquid discharge control system 1, the printer 20 and the like may be separate devices, respectively, which are connected in a communicative manner, or may be integrally formed as one product. For example, the printer 20 may include the control apparatus 10 in a part of the printer body. In this case, the printer 20 including the control apparatus 10 in the printer body corresponds to the liquid discharge control system 1 or the liquid discharge control apparatus as the main entity performing the liquid discharge control method. Further, the printer 20 corresponding to the liquid discharge control system 1 or the liquid discharge control apparatus may be a composite machine that also functions as a scanner, a facsimile machine and the like. Furthermore, the liquid discharge control system 1 or the liquid discharge control apparatus may be referred to as a print (control) system, a print (control) apparatus and the like.

In the control apparatus 10, a CPU 12 constitutes a main portion of computing process and controls the entire portion of the control apparatus 10 through a system bus. The bus may be connected to a ROM 13, a RAM 14, various interfaces (I/F) 19 and the like, and also may be connected to for example, a hard disk drive (HDD) 16 which may be referred to as a storage section. However, the storage section may be formed with a semiconductor memory and the like. The storage section (HDD 16) stores an operating system, an application program, a printer driver PD and the like, which are properly read into the RAM 14 and executed by the CPU 12. The CPU 12, the ROM 13 and the RAM 14 are collectively referred to as a control unit 11. Further, the storage section may store a nozzle usage rate defining mask 16A.

The I/F 19 is connected to the printer 20 in a wired or a wireless manner. Further, the control apparatus 10 includes a display unit 17 configured with for example a liquid crystal display, an operating unit 18 configured with for example a keyboard, a mouse, a touch pad, a touch panel or the like.

Furthermore, all or a part of the items which the control apparatus 10 performs as described in this embodiment may be performed through a predetermined program installed in the printer 20.

In the printer 20, an I/F 25 is connected to the I/F 19 of the control apparatus 10 in a wired or a wireless communicative manner, and the control unit 21 and the like are connected to each other through the system bus. In the control unit 21, a CPU 22 properly reads a program and the like stored in a ROM 23 (firmware) and the like into a RAM 24 to execute a predetermined computing process. The control unit 21 is connected to and controls each of a print head (liquid discharge head) 26, a head drive unit 27, a carriage mechanism 28, and a feeding mechanism 29.

The liquid discharge head 26 receives various types of inks supplied from cartridges (not shown) each of which is provided with one of plural kinds of liquids (for example, cyan (C) ink, magenta (M) ink, yellow (Y) ink, black (K) ink and the like). The liquid discharge head 26 may eject (discharge) the ink from a plurality of nozzles which are provided to be associated with the various types of inks. The specific type or number of the liquids used for the printer 20 is not limited to those mentioned above, and for example, various type of inks such as light cyan (Lc) ink, light magenta ink, orange ink, green ink, gray ink, light gray ink, white ink and metallic inks, or precoat liquid, and any liquid other than the ink such as precoat liquid may also be used.

The carriage mechanism 28 is controlled by the control unit 21 and causes the carriages (not shown) included in the printer 20 to move from one end to the other end (and/or from the other end to the one end) in a main scan direction along a predetermined direction (the main scan direction). The carriage is provided with the liquid discharge head 26 which is moved by the carriage.

Figure 2:
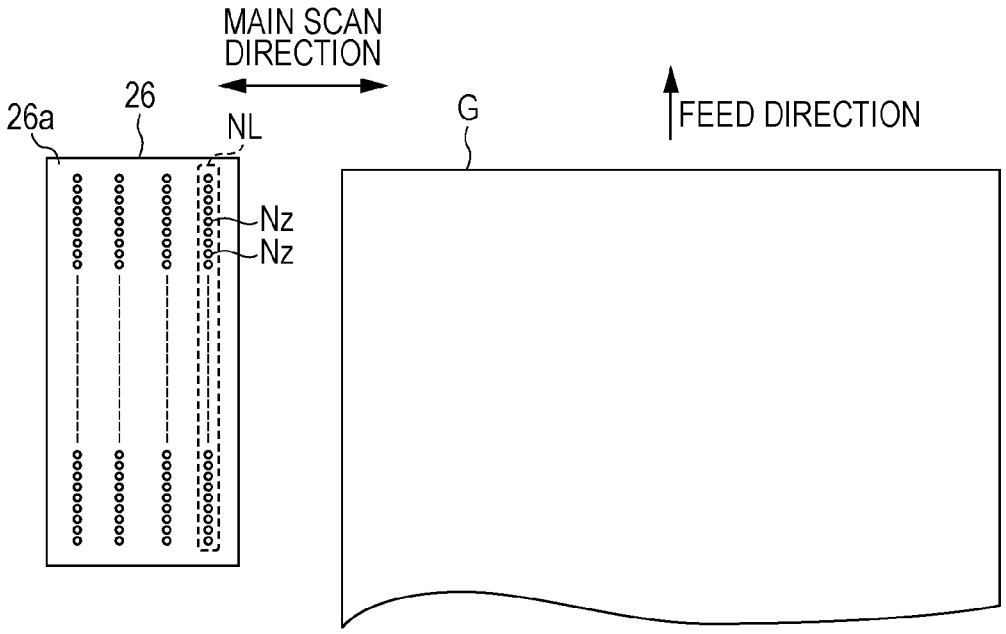
FIG. 2 is a view showing a configuration of a liquid discharge head and the like in simple way.

The feeding mechanism 29 is controlled by the control unit 21 and transports with rollers (not shown) and the like the recording media in the feed direction which intersects (is orthogonal to) the main scan direction (See the recording media G in FIG. 2).

The head drive unit 27 generates a drive voltage for driving piezoelectric elements which are provided to be associated with each nozzle of the liquid discharge head 26, based on a printing data (to be described later) which the control unit 21 acquires from the control apparatus 10 through the I/F 25. The head drive unit 27 outputs the drive voltage to the liquid discharge head 26. The piezoelectric element is deformed when the drive voltage is applied thereto so as to discharge the liquid from the corresponding nozzle. Accordingly, the liquid discharge head 26, which is being moved by the carriage, discharges each type of ink (ink droplets) to the recording media from each nozzle. The discharged ink is attached to the recording media and thus "dots" are formed on the surface of the recording media. Therefore, the image is reproduced on the recording media based on the printing data. Herein, the dot is referred to as the ink which is adherently impacted on the recording media. However, the ink in a stage prior to being adherently impacted on the recording media may be also referred to as the dot for convenience of explanation.

The material used for the recording media is typically paper. However, in addition to the paper, the material used for the recording media may be various types of materials such as textile, plastic, metal, and other natural or artificial materials.

The moving of the liquid discharge head 26 from the one end to the other end or from the other end to the one end along the main scan direction is referred to as the main scanning or the passage.

Further, the head drive unit 27 includes a discharge abnormality detection section 27*a* that detects the abnormal nozzle having the abnormality in the ink discharge.

Furthermore, the printer 20 includes a display unit 30 configured with for example a liquid crystal display, or an operating unit 31 configured with for example a touch button, a touch panel or the like. In the printer 20, the section that discharges the ink droplet from the nozzle is not limited to the piezoelectric element, and a section that heats the ink through a heating element to discharge the ink droplets from the nozzle may be used.

FIG. 2 is a view showing a configuration of the liquid discharge head 26 and the like in the printer 20 in a simple way. In the left side of FIG. 2, an arrangement of the nozzles Nz in the ink discharge surface 26*a* of the liquid discharge head 26 is shown. The ink discharge surface 26*a* is a side to which the nozzle Nz opens, and a side which faces the recording media G when the liquid discharge head 26 performs the main scanning. The liquid discharge head 26 includes a nozzle column NL for each color (for example, CMYK) of the discharged ink. In the nozzle column NL, the nozzles Nz are arranged in an equidistant interval in the feed direction, and in the example of FIG. 2, the nozzle columns NL are disposed in parallel in four columns. The ink of a single color may be discharged from one nozzle column NL, or may be discharged, for example, additionally by a plurality of nozzle columns NL which are shifted to each other in the feed direction.

Further, in the specification, although there are some terminologies such as orthogonal crossing, horizontal, equidistant interval, parallel and the like described for directions and locations of each component, and those terminologies do not necessarily mean strictly orthogonal crossing, the strict horizontal, the strict equidistant interval, the strict parallel and the like, but may mean the inclusion of the error margins to the extent of allowance for the product performance and the error margin to the extent of allowance generated during the manufacturing process.

2. First Embodiment

The first embodiment will be described based on the configuration described above.

Figure 3:
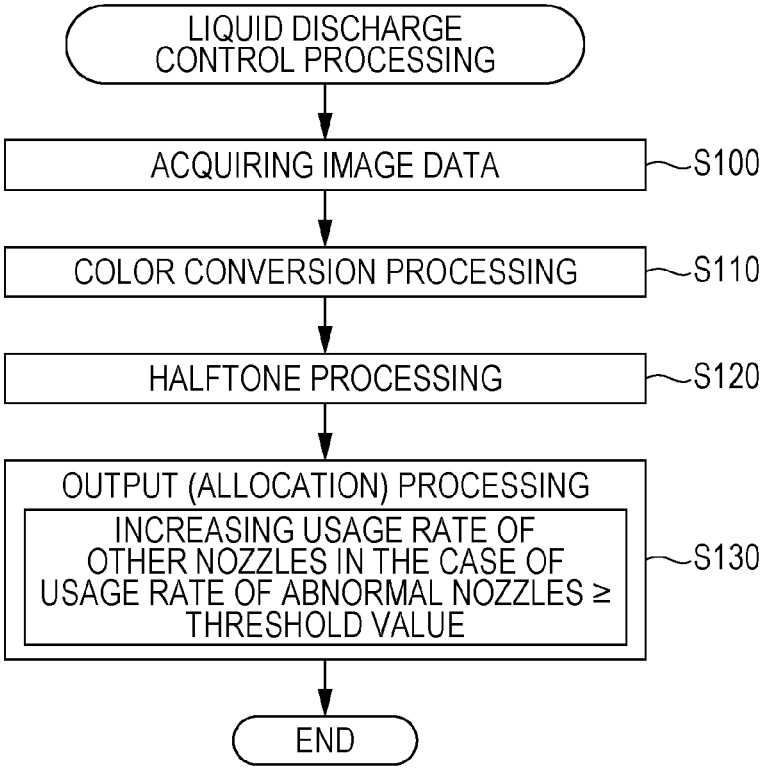
FIG. 3 is a flowchart showing a liquid discharge control processing.

FIG. 3 is a flow chart showing a liquid discharge control processing (a liquid discharge control processing) in which the control apparatus 10 causes the printer 20 to perform a printing according to the printer driver PD.

In step S100, the control unit 11 acquires image data randomly selected by a user from a predetermined input source. The user may view a user interface screen (UI screen) displayed on the display unit 17 and the like and operate the operating unit 18 and the like so as to randomly select the image data for representing the image to be printed on the recording media. The input source of the image data is not limited particularly, and for example, in addition to the HDD 16, and a memory card (not shown) inserted into the control apparatus 10 or the printer 20 from the outside, any type of the image input devices which can be connected with the control apparatus 10 in a communicative manner may be applied thereto.

The image data acquired in step S100 may be for example a bitmap type, or an RGB data in which the density of primary colors such as red (R), green (G), blue (B) is represented in gradation manner (for example, 0 to 255 of 256 gradation) for each pixel. Further, when the acquired image data does not correspond to such a RGB colorimetric system, the control unit 11 converts the acquired image data to the data of the RGB colorimetric system. Furthermore, the control unit 11 properly performs a resolution conversion processing and the like for the image data so as to match a resolution of the image data with a printing resolution in the main scan direction and the feed direction of the printer 20.

In step S110, the control unit 11 performs a color conversion processing for the image data that already went through step S100. Specifically, the colorimetric system used for the image data is converted into the ink colorimetric system (for example CMYK) used for the printing of the printer 20. The color conversion processing is performed for each pixel with reference to a color conversion table (a lookup table) in which a conversion relationship between the colorimetric systems is previously defined. As described above, in the case that the image data represents colors for each pixel in gradation manner of RGB, the gradation value of RGB for each pixel is converted into an ink amount for each CMYK. Such a CMYK value that already went through such a color conversion is represented as for example, a numerical value such as 0 to 100(%) in stage manner, and thus the ink amount (density) for the corresponding pixel is represented in the gradation manner. Hereinafter, such image data represented as the CMYK value for each pixel is referred to as "ink amount data".

In step S120, the control unit 11 performs a halftone processing for the image data (the ink amount data) which already went through step S110, and thus converts the processed image data into printing data. The control unit 11 may perform the halftone processing through a dithering processing in which for example, a dither mask previously defined is used. Alternatively, the control unit 11 may perform the halftone processing using an error diffusion method. Through the halftone processing, it is possible to generate the printing data (dot data) that defines whether the discharge (dot appearing) or non-discharge (dot omission) of each CMYK color ink for each pixel exists. In this case, the higher the value of the ink amount defined by any pixel is in the ink amount data, the higher the possibility of determining the ink discharge for the corresponding pixel becomes as a result of the halftone processing.

In step S130, the control unit 11 aligns the pixels, which constitutes the printing data (dot data) generated in step S120, in an order through which the pixels can be transferred to the liquid discharge head 26 according to a predetermined regulation of nozzle allocation. According to the alignment processing, it is firmly established that the dot which is defined by the pixels constituting the printing data is discharged on the conditions which may include the selection of nozzles in the liquid discharge head 26, the selection of passage numbers and the selected timing of passages that are all determined according to the pixel location and colors of ink. The printing data which went through the alignment processing according to the predetermined regulation of the allocation is output to the printer 20 through the I/F 19 according to the order after the alignment (output processing). Therefore, the pixel constituting the printing data is substantially allocated to any nozzle disposed in the liquid discharge head 26.

The printer 20 controls the main scan (passage) of the liquid discharge head 26, the discharge or non-discharge of ink from each nozzle, and the feed of the recording media based on the printing data which is input through the I/F 25. The printer 20 prints the image on the recording media, and the printed image is represented from the image data acquired in step S100.

Since the processing of steps S120 and S130 is performed by the control unit 11, it can be said that the control unit 11 may function as a discharge control unit that allocates, to the nozzle, the pixels for not only constituting the image but also determining the discharge or non-discharge of the ink so as to resultantly control the ink discharge with the nozzle.

In this embodiment, the printer 20 allocates, to the first nozzle, a pixel of the first ratio in the pixel column that represents one raster line in the main scan direction, and allocates, to the second nozzle, the pixel of the second ratio in the pixel column. And thus, the printer 20 uses a plurality of nozzles which include at least the first nozzle and the second nozzle, and prints the raster line on the recording media. In other words, the printer 20 performs an overlap printing. Further, the predetermined allocation regulation includes at least a rule in which when one nozzle of the first nozzle and the second nozzle is "an abnormal nozzle" having abnormality in the liquid discharge and the ratio of the pixel of the pixel column allocated to the abnormal nozzle is more than or equal to a predetermined ratio with respect to the total of the first ratio and the second ratio, the ratio of the pixel in the pixel column allocated to the other nozzle of the first nozzle and the second nozzle is increased.

Firstly, the abnormal nozzle is comprehensively referred to as a nozzle that does not normally discharge (has an abnormality) the ink droplet even though the drive voltage is applied thereto to perform the discharge operation. The reason for the occurrence of the discharge abnormality is because air bubbles are penetrated into and mixed in the nozzle or the ink flow passage communicating with the nozzle, the ink is dried and thicken (firmly attached) in the vicinity of a nozzle, a paper powder is attached to the vicinity of the nozzle opening, or the like. If the discharge abnormality occurs, as the result thereof, the ink droplet is typically not discharged from the nozzle, and thus there occurs a phenomenon (the dot omission) in which the dot to be originally intended as an image is not formed on the recording media. Further, in the case of the discharge abnormality, even though the ink droplet is discharged from the nozzle, the amount of the liquid may become excessively small, or a flying direction of the ink droplet (impacting passage) may be shifted such that the ink droplet is not properly impacted on to resultantly be also likely to cause the dot omission.

In this embodiment, the control unit 21 of the printer causes 20 the nozzle information NI (see FIG. 1) to be stored for example in EEPROM (not shown) and the like. The nozzle information NI is referred to as the information that describes the discharge abnormality or non-abnormality of each nozzle in the liquid discharge head 26. The nozzle information NI may be any type as long as the nozzle information NI can determine whether or not there is a discharge abnormality or non-abnormality of each nozzle directly or indirectly. In this embodiment, as the process for generating the nozzle information NI, any type of related art may be applied in order to determine and detect the nozzle abnormality. For example, in the printer 20, the discharge abnormality detection section 27*a* may use the technique disclosed in the JP-A-2013-126776 to determine whether or not there is a discharge abnormality of each nozzle, and thus to output the result of the determination as the nozzle information NI to the control unit 21. More specifically, a so-called diaphragm or the like includes a piezoelectric element. If a drive voltage is applied to the piezoelectric element to be deformed, the diaphragm is resultantly bent to generate a waveform (period and the like) of residual vibration which may be measured to resultantly determine whether or not the ink from the nozzle is normally discharged or there is a discharge abnormality. Alternatively, the ink is discharged from each nozzle of the liquid discharge head 26 to print the test pattern, and thus it is possible to manually or automatically evaluate (or determine) whether or not there is the discharge omission on the printed test pattern. Therefore, the discharge abnormality or non-abnormality of each nozzle may be determined to resultantly write the result of the determination as the nozzle information NI.

The processing for allocating pixels to nozzles in step S130 will be described.

Figure 4:
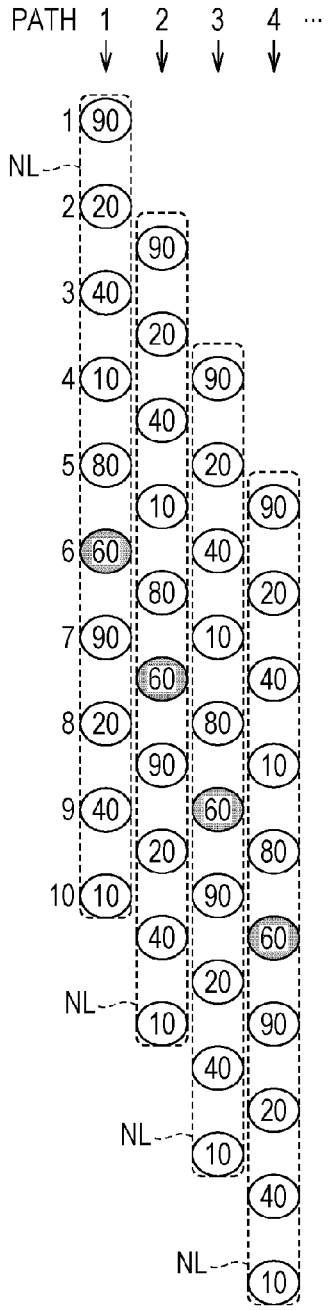
FIG. 4 is a view showing a corresponding relationship between nozzles and pixels according to pre-change usage rate of nozzles in the first embodiment.

FIG. 4 is a view for explaining a corresponding relationship between nozzles and pixels and herein the nozzles constitute the nozzle column NL and the pixels constitute the image data IM allocated to the nozzles. Further, the corresponding relationship between the nozzle and the pixel as shown in FIG. 4 is only for an example, and the corresponding relationship may be changed according to the printing type applied to the printer 20. In the left side of the FIG. 4, for convenience of explanation, an example is shown in which a nozzle column NL corresponding to one color is configured to include ten nozzles (circle marks). Nozzle numbers are written as the numbers 1 to 10 outside of the circle marks for indicating the nozzles arranged along from one end to the other end in the nozzle column NL. Further, in FIG. 4, the circle marks indicate the nozzles of which usage rate is expressed for reference. FIG. 4 shows the changes in a location of one nozzle column NL (a location relative to recording media in the feed direction) for each passage (the first-time passage, the second-time passage, the third-time passage, the four-time passage . . . ) performed by the liquid discharge head 26. In actuality, whenever the liquid discharge head 26 is not moved in the feed direction and also the passage thereof ends, the feeding mechanism 29 moves the recording media by a predetermined feed amount in the feed direction. The nozzle number from the second or higher-time passage is omitted for convenience.

In the right side of FIG. 4, the image data IM is shown as a collection set in which a plurality of pixels (rectangular type) is arranged in X direction (corresponding to the main scan direction) and Y direction (corresponding to the feed direction). The image data IM has resolutions in the X direction and the Y direction which respectively correspond to the resolutions (for example, 720 dpi×720 dpi) in the main scan direction and the feed direction which are applied to the printer 20. In FIG. 4, the numbers 1, 2, 3 . . . , which are written respectively outside of the image data IM in the X direction X and Y direction, indicate the locations of each pixel (X, Y coordinate) in the image data IM. The image data IM shown herein indicates the printing data (dot data) described above, but may be referred to as an image data (RGB data) before the color conversion processing or an image data (ink amount data) after the color conversion processing. In the example of FIG. 4, the numbers in the rectangular box indicating pixels correspond to "nozzle number/passage number" and herein the corresponding pixels are allocated to the numbered nozzles. For example, the pixel indicated with "5/1" corresponds to the pixel allocated to the fifth nozzle of the first-time passage.

In FIG. 4, the intervals (nozzle pitch) between the nozzles, which constitute the nozzle column NL, correspond to 360 nozzle/inch (npi), whereas the resolution of the image data IM in the Y direction corresponds to 720 dpi which is twice as large as the nozzle pitch. For this reason, the feed amount of the recording media for each ending of one time of passage is set to for example 1.5 times as large as the nozzle pitch to resultantly make the printing resolution in the feed direction 720 dpi. Further, the example of the FIG. 4 shows the overlap printing in which the liquid discharge head 26 completes the printing of one "pixel column" with plural times (two times) of passages. In this embodiment, the pixel column is referred to as an area in which the same pixel in the Y coordinate continues from one end of an image data to the other end in the X direction. One pixel column represents one raster line parallel to the main scan direction. The resolution of the image data IM in the X direction is 720 dpi, whereas the liquid discharge head 26 is capable of setting the printing resolution of one time of passage in the main scan direction as 720 dpi. Accordingly, the liquid discharge head 26 may also print all of the pixels, which constitute one pixel column in the image data IM, with one time of passage and one nozzle.

In step S130, the control unit 11 allocates, to some of nozzles, each pixel which constitutes the image data IM based on the printing method set previously for the printer 20. The printing method described herein corresponds to the operation of the printer 20 determined according to the printing resolution in each of the main scan direction and the feed direction, the feed amount of the recording media for each ending of one time of passage mentioned above, the passage times (two times) necessary for printing one pixel column, the contents of the nozzle usage rate defining mask 16A, and the like. To print one pixel column with two times of passages means to print one pixel column with two nozzles (the preceding nozzle used for the preceding passage which is one of two time of passages, and the following nozzle used for the following passage which is one of the two time of passages). In the printing method of the first embodiment, the usage rate for each nozzle of the nozzle numbers 1 to 10 for constituting one nozzle column NL is predetermined as illustrated in the circle marks representing the nozzles in the left side of the FIG. 4. As described above, the usage rate predetermined for each nozzle is referred to as "pre-change usage rate" for convenience of description.

FIG. 5 shows an example of the nozzle usage rate defining mask 16A. The nozzle usage rate defining mask 16A corresponds to a matrix in which the longitudinal axis indicates the nozzle usage rate, and the horizontal axis indicates the location of the pixels in the pixel column. More specifically, the nozzle usage rate in the longitudinal axis corresponds to the usage rate for the preceding nozzle. Further, the total of the usage rates for both the preceding nozzle and the following nozzle is designed to be 100%. Accordingly, the nozzle usage rate 80% defined by the nozzle usage rate defining mask 16A means that the usage rate of the preceding nozzle is 80% and the usage rate of the following nozzle is 20%. In the nozzle usage rate defining mask 16A, "1" indicates a location of the pixel for which the preceding nozzle is used, and "0" indicates a location of the pixel for which the following nozzle is used.

The nozzle usage rate defining mask 16A corresponds to a mask that disperses the pixel locations used for the same nozzles if possible (discontinues the locations if possible).

For example, according to the space of the nozzle usage rate 50% in the nozzle usage rate defining mask 16A, the pixel location "1" used for the preceding nozzle and the pixel location "0" used for the following nozzle are alternatively arranged. Further, in the description related with the nozzle usage rate defining mask 16A and the like, the expression "use" of the nozzle necessarily does not mean to assure the actual usage of the nozzle (an operation of ink discharge performed by a nozzle). Whether or not the ink is discharged from the nozzle depends on whether or not the pixel allocated to the nozzle is a pixel of "dot-existing". Accordingly, in the description related with the nozzle usage rate defining mask 16A and the like, the expression "use" of the nozzle, anywhere, means to allocate the pixels to the nozzles as an information processing (regardless of dot-existing).

The control unit 11 allocates each pixel for each pixel column in the image data IM to the preceding nozzle and the following nozzle based on pre-change usage rate and the nozzle usage rate defining mask 16A. Such a result of the allocation is shown in the image data IM in the right side of the FIG. 4. For example, the pixels constituting the pixel column of Y=1 is allocated to the fifth nozzle of the first-time passage (the preceding nozzle of pre-change usage rate 80%) and the second nozzle of the third-time passage (the following nozzle of pre-change usage rate 20%) by ratio of 8:2, and based on an arrangement configured with spaces of nozzle usage rate 80% in the nozzle usage rate defining mask 16A. Similarly, the pixels constituting the pixel column of Y=2 is allocated to the fourth nozzle of the second-time passage (the preceding nozzle of pre-change usage rate 10%) and the first nozzle of the fourth-time passage (the following nozzle of pre-change usage rate 90%) by ratio of 1:9, and based on an arrangement configured with spaces of nozzle usage rate 10% in the nozzle usage rate defining mask 16A. In light of one pixel column, one of the preceding nozzle and the following nozzle corresponds to "the first nozzle" and the other corresponds to "the second nozzle" in one aspect. Furthermore, the pre-change usage rate of the first nozzle corresponds to "the first ratio" and the pre-change usage rate of the second nozzle corresponds to the second ratio in one aspect.

In step S130, the control unit 11 reads the nozzle information NI described above from the printer 20 to identify that for example, the sixth nozzle (the nozzle represented in gray in FIG. 4) has the discharge abnormality, that is, the sixth nozzle is "an abnormal nozzle" based on the nozzle information NI. Hereinafter, the pixel allocated to the abnormal nozzle is referred to as "abnormal nozzle corresponding pixel". In the case that the abnormal nozzle corresponding pixel is reproduced on the recording media, even when the ink has to be discharged, actually the dot omission may occur. As described above, FIG. 4 exemplarily shows the result of the allocation based on the pre-change usage rate and the nozzle usage rate defining mask 16A, the abnormal nozzle corresponding pixel allocated to the sixth nozzle that is the abnormal nozzle in gray: the abnormal nozzle corresponding pixel (the pixel allocated to the sixth nozzle of first-time passage in the pixel column of Y=3, the pixel allocated to the sixth nozzle of the second-time passage in the pixel column of Y=6, the pixel allocated to the sixth nozzle of the third-time passage in the pixel column of Y=9, and the pixel allocated to the sixth nozzle of the fourth-time passage in the pixel column of Y=12 . . . ). Hereinafter, the pixel column including the abnormal nozzle corresponding pixel is referred to as "abnormal nozzle corresponding pixel column".

In step S130, the control unit 11 determines whether or not the ratio of the abnormal nozzle corresponding pixel (=the pre-change usage rate of the abnormal nozzle) in the abnormal nozzle corresponding pixel column is more than or equal to the predetermined ratio (threshold value) with respect to the total (the total of the first ratio and the second ratio=100%) of the pre-change usage rates of both the preceding nozzle and the following nozzle. The threshold value mentioned herein may be approximately 50% as an example. In the example of FIG. 4, since the sixth nozzle having the pre-change usage rate of 60% is the abnormal nozzle, in the case of the threshold value of 50%, it is determined that the ratio of the abnormal nozzle corresponding pixel in the abnormal nozzle corresponding pixel column is more than or equal to the corresponding threshold value.

In step S130, in the case that the control unit 11 determines that the ratio of the abnormal nozzle corresponding pixel in the abnormal nozzle corresponding pixel column is more than or equal to the threshold value, the control unit 11 increases the ratio of the pixel (the pixel corresponds to the pixel allocated to "the other nozzle" in one aspect which pixel is not the abnormal nozzle corresponding pixel of the corresponding pixel column. As an example of the scheme for increasing the pixel, a scheme (the first scheme) for simply changing the pre-change usage rate of the preceding nozzle and the pre-change usage rate of the following nozzle with each other may be considered. In other words, since the threshold value is 50% and the pre-change usage rate of the abnormal nozzle is more than or equal to the threshold value, the pre-change usage rate of the preceding nozzle and the pre-change usage rate of the following nozzle in the abnormal nozzle corresponding pixel column are changed with each other to resultantly decrease the ratio of the abnormal nozzle corresponding pixel in the corresponding pixel column and increase the ratio of the pixel which is not the abnormal nozzle corresponding pixel. According to the example of FIG. 4, if the pre-change usage rate of the preceding nozzle and the pre-change usage rate of the following nozzle in the abnormal nozzle corresponding pixel column are changed with each other, the ratio of the abnormal nozzle corresponding pixel in the corresponding pixel column decreases from 60% to 40%, and the ratio of the pixel which is not the abnormal nozzle corresponding pixel increases from 40% to 60%. The control unit 11 allocates each pixel in the abnormal corresponding pixel column among the pixel columns of the image data IM to the preceding nozzle and the following nozzle (reallocating), based on the usage rate after changing (referred to as "post-change usage rate") generated through such a first scheme, and also the nozzle usage rate defining mask 16A.

In step S130, in the case that the ratio of the abnormal nozzle corresponding pixel in the abnormal nozzle corresponding pixel column is more than or equal to the threshold value, the scheme for increasing the ratio of the pixel which is not the abnormal nozzle corresponding pixel in the corresponding pixel column is not limited to the first scheme. For example, the control unit 11 may use not only the pre-change usage rate of the preceding nozzle and the pre-change usage rate of the following nozzle in the abnormal nozzle corresponding pixel column, but also may use a scheme (the second scheme) for, up to a certain value, increasing the usage rate for the nozzle (corresponding to "the other nozzle" in one aspect) which nozzle is not any abnormal nozzle of the preceding nozzle and the following nozzle. In the case of the second scheme, although the pre-change usage rate of the abnormal nozzle is 60%, as shown in FIG. 4, the control unit 11 changes the usage rate of the abnormal nozzle from the current value 60% to for example about 30% to 0%, and changes the usage rate of the other nozzle from the current value 40% to for example about 70% to 100%. The control unit 11 allocates each pixel in the abnormal nozzle corresponding pixel column among the pixel columns of the image data IM to the preceding nozzle and the following nozzle (reallocating), based on the usage rate after changing (referred to as "post-change usage rate") generated through the second scheme, and also the nozzle usage rate defining mask 16A.

FIG. 6A shows, as a result, that the control unit 11 allocates each pixel in the abnormal nozzle corresponding pixel column to the preceding nozzle and the following nozzle, based on the post-change usage rate obtained through the first scheme, and also the nozzle usage rate defining mask 16A. Similarly, FIG. 6B shows as a result that the control unit 11 allocates each pixel in the abnormal nozzle corresponding pixel column to the preceding nozzle and the following nozzle, based on the post-change usage rate obtained through the second scheme, and also the nozzle usage rate defining mask 16A. In the case of comparing the image data IM shown in FIG. 6A and FIG. 6B respectively with the image data IM shown in FIG. 4, there is a difference in the corresponding relationship between the pixel and the nozzle only in the abnormal nozzle corresponding pixel column (pixel column of Y=3, 6, 9, 12 . . . ), the abnormal nozzle corresponding pixel allocated to the abnormal nozzle (the sixth nozzle) is decreased and the pixel allocated to the other nozzle is increased. In the example of FIG. 6A, in the abnormal nozzle corresponding pixel column, the ratio of the abnormal nozzle corresponding pixel is 40% and the ratio of the pixel allocated to the other nozzle is 60%. In the example of FIG. 6B, in the abnormal nozzle corresponding pixel column, the ratio of the abnormal nozzle corresponding pixel is 20% and the ratio of the pixel allocated to the other nozzle is 80%. Similarly to FIG. 4, also in FIG. 6A and FIG. 6B, the abnormal nozzle corresponding pixel allocated to the sixth nozzle which is the abnormal nozzle is exemplarily shown in gray.

Based on the image data IM (see for example FIG. 6A or FIG. 6B) which allocates each pixel in such an abnormal nozzle corresponding pixel column to the preceding nozzle and the following nozzle, based on post-change usage rate and the nozzle usage rate defining mask 16A, the control unit 11 controls the discharge or non-discharge of the ink supplied from each nozzle of the liquid discharge head 26. Of course, not only in the case that non-existence of the abnormal nozzle is identified with reference to the nozzle information NI but also in the case that existence of the abnormal nozzle is identified, if the control unit 11 determines that the ratio (=pre-change usage rate of the abnormal nozzle) of the abnormal nozzle corresponding pixel in the abnormal nozzle corresponding pixel column is less than the threshold value, based on the image data IM (see for example FIG. 4) which allocates each pixel to the preceding nozzle and the following nozzle, based on the pre-change usage rate and the nozzle usage rate defining mask 16A, the control unit 11 controls the discharge or non-discharge of the ink supplied from each nozzle of the liquid discharge head 26.

The working effect of the first embodiment will be described. According to the first embodiment, in the case that one raster line is recorded on the recording media using the preceding nozzle and the following nozzle, even though one nozzle of the preceding nozzle and the following nozzle is the abnormal nozzle, only if the ratio of the pixel allocated to one nozzle in the pixel column representing the corresponding raster line is more than or equal to the threshold value (for example 50%), the ratio of the pixel in the pixel column allocated to the other nozzle (the nozzle which is not the abnormal nozzle) of the preceding nozzle and the following nozzle (the nozzle which is not the abnormal nozzle) is increased.

Specifically, in the case that the dot omission can occur corresponding to the pixel of which ratio is more than or equal to the threshold value when the raster line is reproduced (in the case that the dot omission is exposed to view in the raster line), the usage rate of the other nozzle is increased (the post-change usage rate is applied to) to resultantly decrease the number of those dot omissions and thus suppress the degradation of the quality of image which may be caused by the visual exposure of the dot omission. On the other hand, in the case that the dot omission can occur corresponding to the pixel of which ratio is less than the threshold value when the raster line is reproduced, since the dot omission is not exposed to view in the raster line, the usage rate of the other nozzle is not increased (the post-change usage rate is not applied to) but the usage rate of the same nozzle as that at the time of recording the raster line is increased (the usage rate of the other is increased) to resultantly avoid the degradation of the quality of image which would occur otherwise. Accordingly, since the degradation of the quality of image due to the dot omission and the degradation of the quality of image due to the excessive use of the same nozzle as that at the time of recording the raster line may be suppressed with good balance, the quality of image can be entirely improved even in the case that the abnormal nozzle exists.

The invention is not limited to the embodiment described above, and various aspects may be implemented without departing from the scope thereof. For example, the following embodiments or modification examples may be applied. Any configuration which may be designed through any possible combination of each embodiment and each modification example is within the scope of the disclosure of the invention. In the description of the following embodiments or modification examples, the same items as those of the first embodiment will not be repeated properly.

3. Second Embodiment

Figure 7:
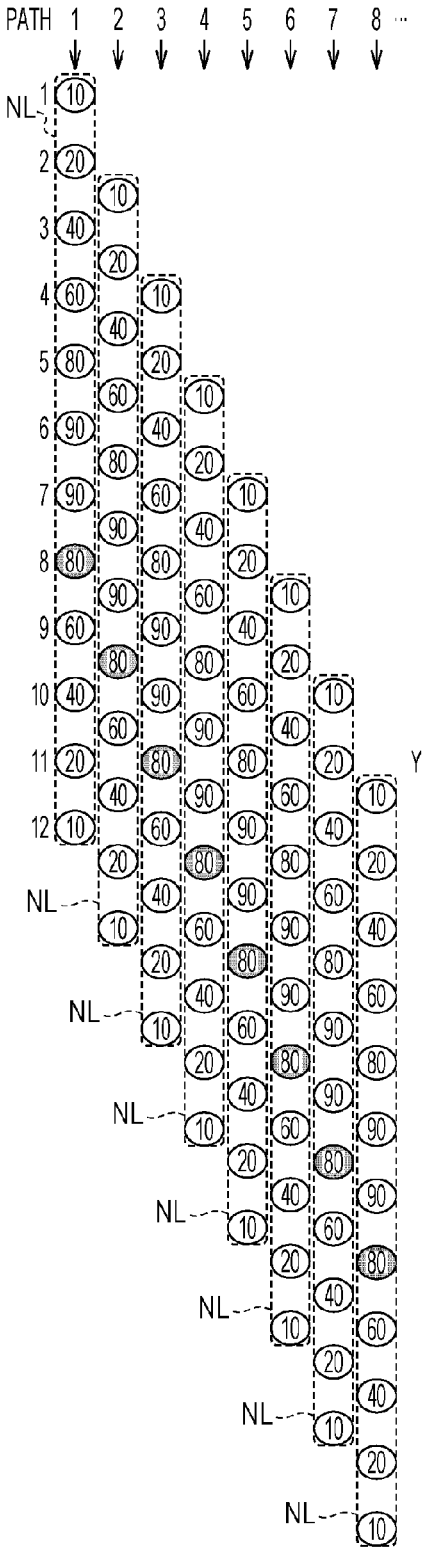
FIG. 7 is a view showing a corresponding relationship between nozzles and pixels according to pre-change usage rate of nozzles in the second embodiment.

FIG. 7 is a view showing a corresponding relationship between the nozzle constituting the nozzle column NL and the pixels constituting the image data IM allocated to the nozzle according to the second embodiment. In the left side of the FIG. 7, an example is exemplarily shown in which a nozzle column NL corresponding to one ink color is configured to include twelve nozzles (circle marks). Nozzle numbers is written as the numbers 1 to 12 outside of the circle marks for indicating the nozzles arranged along from one end to the other end in the nozzle column NL. Similar to FIG. 4, FIG. 7 also shows the usage rate of the nozzle (pre-change usage rate) described for the reference in the circle mark for indicating the nozzle, and shows the changes in the location of one nozzle column NL (a location relative to recording media in the feed direction) for each passage (the first-time passage, the second-time passage, the third-time passage, the fourth-time passage . . . ) performed by the liquid discharge head 26. The nozzle number for the second or more passages is not repeated for convenience.

Similar to FIG. 4, in the right side of FIG. 7, the image data IM is illustrated as a collection set in which a plurality of pixels (rectangular type) is arranged in X direction and Y direction. The numbers 1, 2, 3 . . . written respectively outside of the image data IM in each of the X direction and the Y direction, and the numbers in the rectangular box indicating the pixel have the same meanings as those described in FIG. 4. The example of the FIG. 7 shows the overlap printing in which the liquid discharge head 26 completes the printing of one pixel column with four times of passage. In the second embodiment, the resolution of the image data IM in the X direction is 720 dpi, whereas the liquid discharge head 26 is capable of setting the printing resolution of one time of passage in the main scan direction as 360 dpi. Accordingly, in the second embodiment, the liquid discharge head 26 may not print all of the pixels constituting one pixel column in the image data IM with one time of passage and one nozzle.

Specifically, in the second embodiment, the printer 20 prints the odd pixel of which X coordinate value is the odd (X=1, 3, 5 . . . ) in one pixel column through two times of passages, and prints the even pixels of which X coordinate value is the even (X=2, 4, 6 . . . ) in the one pixel column through further two times of passages. In such a printing method of the second embodiment, the nozzle which is used for the preceding passage of two times of passages in order to print the odd pixel in on pixel column is referred to as the first preceding nozzle, and the nozzle which is used for the following passage in order to print the odd pixel is referred to as the first following nozzle. Further, the nozzle which is used for the preceding passage of two times of passages in order to print the even pixel in one pixel column is referred to as the second preceding nozzle, and the nozzle which is used for the following passage in order to print the even pixel is referred to as the second following nozzle. Total of the pre-change usage rate of the first preceding nozzle and the pre-change usage rate of the first following nozzle is 100%, which, however, means 100% of the odd pixel in the one pixel column. Similarly, total of the pre-change usage rate of the second preceding nozzle and the pre-change usage rate of the second following nozzle is 100%, which, however, means 100% of the even pixel in the one pixel column.

According to the second embodiment, in light of one pixel column, in the case that one of the first preceding nozzle and the first following nozzle is the abnormal nozzle, one of the first preceding nozzle and the first following nozzle corresponds to "the first nozzle" and the other corresponds to "the second nozzle". Further, in the case that one of the second preceding nozzle and the second following nozzle is the abnormal nozzle, one of the second preceding nozzle and the second following nozzle corresponds to "the first nozzle" and the other corresponds to "the second nozzle".

Similar to the first embodiment, in step S130 (FIG. 3), the control unit 11 allocates each pixel for each pixel column in the image data IM to the nozzle, based on the pre-change usage rate and the nozzle usage rate defining mask 16A. A result of such an allocation is shown in the image data IM in the right side of the FIG. 7. For example, the odd pixels constituting the pixel column of Y=1 is allocated to the first nozzle of the first-time passage (the first preceding nozzle of pre-change usage rate 20%) and the eleventh nozzle of the fifth-time passage (the first following nozzle of the pre-change usage rate 80%) by ratio of 2:8, and based on an arrangement configured with spaces of nozzle usage rate 20% in the nozzle usage rate defining mask 16A. In the case that the nozzle usage rate defining mask 16A is applied to the odd pixel which is allocated to the preceding nozzle (the first preceding nozzle) and the following nozzle (the first following nozzle), the nozzle usage rate defining mask 16A is applied to the column of the odd pixel arranged and filled between only the odd pixels extracted. Further, the even pixels constituting the pixel column of Y=1 is allocated to the eighth nozzle of the third-time passage (the second preceding nozzle of pre-change usage rate 80%) and the second nozzle of the seventh-time passage (the second following nozzle of pre-change usage rate 20%) by ratio of 8:2, and based on an arrangement configured with spaces of nozzle usage rate 80% in the nozzle usage rate defining mask 16A. Also, in the case that the nozzle usage rate defining mask 16A is applied to the even pixel which is allocated to the preceding nozzle (the second preceding nozzle) and the following nozzle (the second following nozzle), the nozzle usage rate defining mask 16A is applied to the column of the even pixel arranged and filled between only the even pixels extracted.

Similarly, the odd pixel constituting the pixel column of Y=2 is allocated to the seventh nozzle of the fourth-time passage (the first preceding nozzle of pre-change usage rate 90%) and the first nozzle of the eighth-time passage (the first following nozzle of the pre-change usage rate 10%) by ratio of 9:1, and based on an arrangement configured with spaces of nozzle usage rate 90% in the nozzle usage rate defining mask 16A. The even pixels constituting the pixel column of Y=2 is allocated to the tenth nozzle of the second-time passage (the second preceding nozzle of pre-change usage rate 40%) and the fourth nozzle of the sixth-time passage (the second following nozzle of pre-change usage rate 60%) by ratio of 4:6, and based on an arrangement configured with spaces of nozzle usage rate 40% in the nozzle usage rate defining mask 16A.

In step S130, the control unit 11 reads the nozzle information NI described above from the printer 20 to identify that for example, the eighth nozzle (the nozzle represented in gray in FIG. 7) is "an abnormal nozzle" based on the nozzle information NI. FIG. 7 exemplarily shows the result of the allocation based on the pre-change usage rate and the nozzle usage rate defining mask 16A, the abnormal nozzle corresponding pixel allocated to the eighth nozzle that is the abnormal nozzle in gray: the abnormal nozzle corresponding pixel (the pixel allocated to the eighth nozzle (the second preceding nozzle) of the third-time passage of the even pixel in the pixel column of Y=1, the pixel allocated to the eighth nozzle (the first preceding nozzle) of the fourth-time passage of the odd pixel in the pixel column of Y=4 . . . ).

In step S130, if the abnormal nozzle corresponding pixel in the abnormal nozzle corresponding pixel column is the odd pixel, the control unit 11 determines whether or not the share ratio of the abnormal nozzle corresponding pixel in the odd pixel (=the pre-change usage rate of the abnormal nozzle) is more than or equal to a predetermined ratio (the threshold value), whereas if the abnormal nozzle corresponding pixel is the even pixel, the control unit 11 determines whether or not the share ratio of the abnormal nozzle corresponding pixel in the even pixel (=the pre-change usage rate of the abnormal nozzle) is more than or equal to the threshold value. In the example of FIG. 7, the eighth nozzle of which pre-change usage rate is 80% is the abnormal nozzle. Accordingly, in the case that the threshold value is 50%, if the abnormal nozzle corresponding pixel in the abnormal nozzle corresponding pixel column is the odd pixel, the share ratio which the abnormal nozzle corresponding pixel in the abnormal corresponding pixel column has in 100% of the odd pixel is determined as being more than or equal to the threshold value. Further, in the case that the threshold value is 50%, if the abnormal nozzle corresponding pixel in the abnormal nozzle corresponding pixel column is the even pixel, the share ratio which the abnormal nozzle corresponding pixel in the abnormal corresponding pixel column has in 100% of the even pixel is determined as being more than or equal to the threshold value.

As described above, in the case that the control unit 11 determines that the ratio of the abnormal nozzle corresponding pixel in the abnormal nozzle corresponding pixel column is more than or equal to the threshold value, similar to the first embodiment, the control unit 11 increases the ratio of the pixel which is not the abnormal nozzle corresponding pixel of the corresponding pixel column, using for example, the first scheme or the second scheme. According to the example of FIG. 7 and the first scheme, if the pre-change usage rates of the abnormal nozzle and the nozzle (corresponding to the other nozzle in one aspect) are changed with each other, the usage rate of the abnormal nozzle decreases from 80% to 20%, the usage rate of the other nozzle increases from 20% to 80%. The nozzle corresponding to the other nozzle in the claim has a function for generating the relationship between the first preceding nozzle and the first following nozzle (or the second preceding nozzle and the second following nozzle) with the abnormal nozzle combined. The control unit 11 allocates each pixel in the abnormal nozzle corresponding pixel column among the pixel column of the image data IM to the nozzle (reallocating), based on the usage rate after changing (post-change usage rate), and also the nozzle usage rate defining mask 16A.

Alternatively, according to the second scheme, in the case that the pre-change usage rate of the abnormal nozzle is 80%, as shown in FIG. 7, for example, the control unit 11 decreases the usage rate of the abnormal nozzle to about 10% to 0%, and increases the usage rate of the other nozzle to about 90% to 100%. Therefore, the control unit 11 allocates each pixel in the abnormal nozzle corresponding pixel column among the pixel column of the image data IM to the nozzle (reallocating), based on the usage rate after changing (post-change usage rate) generated through the second scheme, and also the nozzle usage rate defining mask 16A.

FIG. 8A shows, as a result, that the control unit 11 allocates each pixel in the abnormal nozzle corresponding pixel column to the nozzle, based on the post-change usage rate obtained through the first scheme, and also the nozzle usage rate defining mask 16A. Similarly, FIG. 8B shows, as a result, that the control unit 11 allocates each pixel in the abnormal nozzle corresponding pixel column to the nozzle, based on the post-change usage rate obtained through the second scheme, and also the nozzle usage rate defining mask 16A. In the case of comparing the image data IM shown in FIG. 8A and FIG. 8B respectively with the image data IM shown in FIG. 7, there is a difference in the corresponding relationship between the pixel and the nozzle only in the abnormal nozzle corresponding pixel column (the pixel column of Y=1, 4 . . . ), the abnormal nozzle corresponding pixel allocated to the abnormal nozzle (the eighth nozzle) is decreased and the pixel allocated to the other nozzle is increased. Similar to FIG. 7, also in FIG. 8A and FIG. 8B, the abnormal nozzle corresponding pixel allocated to the eighth nozzle which is the abnormal nozzle is exemplarily shown in gray.

Specifically, in FIG. 8A, the ratio of the pixel allocated to the second preceding nozzle as the abnormal nozzle (the eighth nozzle of the third-time passage) among the even pixels in the pixel column of Y=1 (the abnormal nozzle corresponding pixel column) is 20%, and the ratio of the pixel allocated to the second following nozzle as the other nozzle (the second nozzle of seventh-time passage) is 80%. Further, the ratio of the pixel allocated to the first preceding nozzle as the abnormal nozzle (the eighth nozzle of the fourth-time passage) among the odd pixels in the pixel column of Y=4 (the abnormal nozzle corresponding pixel column) is 20%, and the ratio of the pixel allocated to the first following nozzle as the other nozzle (the second nozzle of the eighth-time passage) is 80%.

Furthermore, in FIG. 8B, the ratio of the pixel allocated to the second preceding nozzle as the abnormal nozzle (the nozzle of the eighth nozzle of the third-time passage) among the even pixels in the pixel column of Y=1 (the abnormal nozzle corresponding pixel column) is 10%, and the ratio of the pixel allocated to the second following nozzle as the other nozzle (the second nozzle of seventh-time passage) is 90%. Further, the ratio of the pixel allocated to the first preceding nozzle as the abnormal nozzle (the nozzle of the eighth nozzle of the fourth-time passage) among the odd pixels in the pixel column of Y=4 (the abnormal nozzle corresponding pixel column) is 10%, and the ratio of the pixel allocated to the first following nozzle as the other nozzle (the second nozzle of eighth-time passage) is 90%.

Based on the image data IM (see for example FIG. 8A or FIG. 8B) which allocates each pixel in the abnormal nozzle corresponding pixel column to the nozzle based on the post-change usage rate and the nozzle usage rate defining mask 16A, the control unit 11 controls the discharge or non-discharge of the ink supplied from each nozzle of the liquid discharge head 26. Of course, not only in the case that non-existence of the abnormal nozzle is identified with reference to the nozzle information NI but also in the case that existence of the abnormal nozzle is identified, if the control unit 11 determines that the ratio (=pre-change usage rate of the abnormal nozzle) of the abnormal nozzle corresponding pixel in the abnormal nozzle corresponding pixel column is less than the threshold value, based on the image data IM (see for example FIG. 7) which allocates each pixel to the preceding nozzle and the following nozzle, based on the pre-change usage rate and the nozzle usage rate defining mask 16A, the control unit 11 control the discharge or non-discharge of the ink supplied from each nozzle of the liquid discharge head 26.

In the second embodiment, the same effect as that of the first embodiment also can be attained. Specifically, according to the second embodiment, when the raster line is reproduced, in the case that the dot omission can occur corresponding to the pixel of which ratio is more than or equal to the threshold value among all of the odd pixels, or in the case that the dot omission can occur corresponding to the pixel of which ratio is more than or equal to the threshold value among all of the even pixels (in the case that the dot omission is exposed to view in the raster line), the usage rate of the other nozzle is increased (the post-change usage rate is applied to) to resultantly decrease the number of those dot omissions and thus suppress the degradation of the quality of image which may be caused by the visual exposing of the dot omission. In the other hand, when the raster line is reproduced, in the case that the dot omission can occur corresponding to the pixel of which ratio is less than the threshold value among all of the odd pixels, or in the case that the dot omission can occur corresponding to the pixel of which ratio is less than the threshold value among all of the even pixels, the dot omission is not exposed to view in the raster line. For this reason, the usage rate of the other nozzle is not increased (the post-change usage rate is not applied to) but the usage rate of the same nozzle as that at the time of recording the raster line is increased (the usage rate of the other is increased) to resultantly avoid the degradation of the quality of image which would occur otherwise. Accordingly, the degradation of the quality of image which is generated due to the dot omission and the degradation of the quality of image which is generated due to the excessive use of the same nozzle as that at the time of recording the raster line may be suppressed with good balance, and the quality of image can be entirely improved even in the case that the abnormal nozzle exists.

4. Modification Examples

First Modification Example

The threshold value which corresponds to "a predetermined ratio" in one aspect is not limited to only 50%. For example, the more easily the liquid ink is permeated into the recording media, the more a discharge control unit (control unit 11) may increase the threshold value. The reason for this is because the permeation (spread) of the ink impacted in the vicinity of the generated ink omission causes an embedding effect of the dot omission to be increased in the case that the recording media has a characteristic of permeating the ink easily.

A user may operate the operating unit 18 and 31 and the like to randomly select and set any one from the various recording media such as glossy papers and general-purpose papers which are different in the degree of the permeability of ink used for the printer 20. Herein, the printer 20 may be used to print the first recording media which may be at least any type of paper, and the second recording media which has higher permeability than that of the first recording media. Further, in the case that the first recording media is set as the recording media, the control unit 11 sets the first threshold value as the threshold value, whereas in the case that the second recording media is set as the recording media, the control unit 11 sets the second threshold value as the threshold value which is higher than the first threshold. As an example, the first threshold value=50%, the second threshold value=70% and the like may be set.

In such a configuration, and in the case of the first embodiment, it is assumed that the preceding nozzle for recording the pixel column which represents certain raster lines is the abnormal nozzle, and the pre-change usage rate of the abnormal nozzle is 60% (the pre-change usage rate of the following nozzle for recording the pixel column is 40%). In this case, if the recording media is the first recording media, since the pre-change usage rate 60% of the abnormal nozzle is more than or equal to the threshold value (the first threshold value=50%), the control unit 11 increases the usage rate of the following nozzle for recording the corresponding pixel column (the control unit 11 increases the pixel allocated to the following nozzle in the corresponding pixel column) in step S130. In other hand, if the recording media is the second recording media, since the pre-change usage rate 60% of the abnormal nozzle is less than the threshold value (the second threshold value=70%), the control unit 11 does not increase the usage rate of the following nozzle for recording the corresponding pixel column (the control unit 11 uses the pre-change usage rates of each of the preceding nozzle (the abnormal nozzle) and the following nozzle without change) in step S130.

In the case of the second embodiment, it is assumed that the first preceding nozzle for recording the pixel column which represents certain raster lines is the abnormal nozzle, and the pre-change usage rate of the abnormal nozzle is 60% (the pre-change usage rate of the first following nozzle for recording the pixel column is 40%). In this case, if the recording media is the first recording media, since the pre-change usage rate 60% of the abnormal nozzle is more than or equal to the threshold value (the first threshold value=50%), the control unit 11 increases the usage rate of the first following nozzle for recording the corresponding pixel column (the usage rate corresponds to the ratio of the pixel allocated to the first following nozzle among the odd pixel 100%) in step S130. In other hand, if the recording media is the second recording media, since the pre-change usage rate 60% of the abnormal nozzle is less than the threshold value (the second threshold value=70%), the control unit 11 does not increase the usage rate of the first following nozzle for recording the corresponding pixel column (the control unit 11 uses the pre-change usage rates of each of the first preceding nozzle (abnormal nozzle) and the first following nozzle without change) in step S130.

According to the first modification example, in the case of using the recording media which has relatively higher permeability of ink, since it is considered that the ink omission is not likely to be exposed to view, the threshold value is set to a relatively higher value. Whereas, in the case of using the recording media which has relatively lower permeability of ink, since it is considered that the ink omission is likely to be exposed to view, the threshold value is set to a relatively lower value. For this reason, in the case of recording the raster line, if it is necessary to suppress the degradation of quality of image which may be caused by the dot omission, the usage rate of the other nozzle is increased to resultantly improve the entire quality of image regardless of the recording media to be used.

Second Modification Example

In the descriptions for FIG. 4, FIG. 6A and FIG. 6B, FIG. 7, FIG. 8A and FIG. 8B, there is provided examples of the nozzle column which discharges the ink of a single color (for example C) selected among the inks of all colors (for example CMYK) that the liquid discharge head 26 discharges. However, the same description may be applied to the case in which each nozzle column discharges other inks (for example MYK). Specifically, the processing of step S130 is performed for each of the various dot data such as dot data (one type of the image data IM) for defining discharge or non-discharge of C ink for each pixel, dot data (one type of the image data IM) for defining discharge or non-discharge of M ink for each pixel, dot data (one type of the image data IM) for defining discharge or non-discharge of Y ink for each pixel, dot data (one type of the image data IM) for defining discharge or non-discharge of K ink for each pixel . . . , respectively.

However, in the case of the ink of relatively low density (for example Y), even though there are relatively many dot omissions of the ink, the dot omission is likely to be hardly exposed to view. Whereas, in the case of the ink of relatively high density (for example K), even though there are relatively few dot omissions of the ink, the dot omission is likely to be easily exposed to view. Therefore, the control unit 11 may change the threshold value to different values according to the colors of ink. Specifically, the liquid discharge head 26 may be able to discharge at least the first ink and the second ink of which density is higher than that of the first ink as a liquid, and the discharge control unit (control unit 11) may set the threshold value used in the case that the first nozzle and the second nozzle correspond to a nozzle for discharging the first ink, to a value higher than the threshold value used in the case that the first nozzle and the second nozzle correspond to a nozzle for discharging the second ink.

As an example, the control unit 11 may set the first ink as Y ink, and the second ink as K ink. Further, in step S130, in the case that the dot data (a type of image data IM) for defining discharge or non-discharge of Y ink for each pixel is a target to be processed, the third threshold value is set as the threshold value, in the case that the dot data (a type of image data IM) for defining discharge or non-discharge of K ink for each pixel is a target to be processed, the fourth threshold value which is lower than the third threshold value is set as the threshold value. As an example, the third threshold value=70%, the fourth threshold value=40% and the like may be set.

In such a configuration, and in the case of the first embodiment, it is assumed that as the nozzle constituting the nozzle column NL for discharging the first ink (Y ink), the preceding nozzle for recording the pixel column which represents certain raster lines is the abnormal nozzle, and the pre-change usage rate of the abnormal nozzle is 60%. In this case, since the pre-change usage rate 60% of the abnormal nozzle is less than or equal to the threshold value (the third threshold value=70%), the control unit 11 does not increase the usage rate of the following nozzle that discharges the first ink (Y ink) for recording the corresponding pixel column in step S130. In the other hand, in the first embodiment, it is assumed that as the nozzle constituting the nozzle column NL for discharging the second ink (K ink), the preceding nozzle for recording the pixel column which represents certain raster lines is the abnormal nozzle, and the pre-change usage rate of the abnormal nozzle is 60%. In this case, since the pre-change usage rate 60% of the abnormal nozzle is more than or equal to the threshold value (the fourth threshold value=40%), the control unit 11 increases the usage rate of the following nozzle that discharges the second ink (K ink) for recording the corresponding pixel column in step S130.

Further, in the case of the second embodiment, it is assumed that as the nozzle constituting the nozzle column NL for discharging the first ink (Y ink), the first preceding nozzle for recording the pixel column which represents certain raster lines is the abnormal nozzle, and the pre-change usage rate of the abnormal nozzle is 60%. In this case, since the pre-change usage rate 60% of the abnormal nozzle is less than the threshold value (the third threshold value=70%), the control unit 11 does not increase the usage rate of the first following nozzle that discharges the first ink (Y ink) for recording the corresponding pixel column in step S130. In the other hand, in the second embodiment, it is assumed that as the nozzle constituting the nozzle column NL for discharging the second ink (K ink), the first preceding nozzle for recording the pixel column which represents certain raster lines is the abnormal nozzle, and the pre-change usage rate of the abnormal nozzle is 60%. In this case, since the pre-change usage rate 60% of the abnormal nozzle is more than or equal to the threshold value (the fourth threshold value=40%), the control unit 11 increases the usage rate of the first following nozzle that discharges the second ink (K ink) for recording the corresponding pixel column in step S130. Furthermore, the threshold value for C ink or M ink may be the same value as the threshold value for the K ink (the fourth threshold value), or may be lower than the threshold value (the third threshold value) for Y ink and also higher than the threshold value (the fourth threshold value) for K ink.

According to the second modification example, the threshold value is set to relatively higher value for the ink (the first ink) through which the dot omission is relatively hardly exposed to view, whereas the threshold value is set to relatively lower value for the ink (the second ink) through which the dot omission is relatively easily exposed to view. For this reason, in the case of recording the raster line, if it is necessary to suppress the degradation of quality of image which may be caused by the dot omission, the usage rate of the other nozzle is increased to resultantly improve the entire quality of image obtained using the various colors of ink.

Third Modification Example

In the case that one nozzle of "the first nozzle" and "the second nozzle" is the abnormal nozzle, and a ratio (the pre-change usage rate) of the pixel allocated to the abnormal nozzle is more than or equal to the threshold value with respect to the total (100%) of "the first ratio" and "the second ratio", the discharge control unit (control unit 11) may selectively perform one of "the first mode" and "the second mode". The first mode is defined as a mode in which the ratio of the pixel allocated to the other nozzle of "the first nozzle" and "the second nozzle" is increased, and the second mode is defined as a mode in which the ratio of the pixel allocated to the other nozzle is not changed regardless of whether or not one of "the first nozzle" and "the second nozzle" is abnormal nozzle. Further, according to a type of image that includes the pixel column, the control unit 11 selects and performs one of the first mode and the second mode. Furthermore, in the second mode, without determining whether or not the abnormal nozzle exists, in step S130, the control unit 11 allocates each pixel for each pixel column of the image data IM to any nozzle simply according to the pre-change usage rate for each nozzle.

The types of the image described herein may be the types of the contents represented by the image data which is acquired in the step S100, and the types may be classified into documents (texts), CG, photographs and the like. The control unit 11 may specify the type of image for example through translation of image data acquired in step S100 (for example the translation of color numbers included in an image, a histogram of an image and the like) or may specify the type of image from a file extension included in a file of the image data acquired in step S100. Furthermore, if the specified type of image is the first type in which the dot omission is relatively easily exposed to view (the type of image that has relatively large area on which ink is covered in the recording media, for example photographs), the control unit 11 performs the first mode, whereas if the specified type of image is the second type in which the dot omission is relatively hardly exposed to view (the type of image that has relatively large area on which ink is not covered in the recording media, for example text), the control unit 11 performs the second mode.

According to the third modification example, a processing (the first recording mode) for decreasing the dot omission is selectively subjected to the image of a type of which quality may be easily improved through the decreasing of the dot omission. Therefore, a processing which hardly provides an effect for improving the quality of image (a processing for decreasing the dot omission is subjected to the image of which quality may be hardly improved through the decreasing of the dot omission) may be avoided to resultantly reduce a burden which the control unit 11 may have for performing the processing.

Fourth Modification Example

In the first embodiment in which one raster line is recorded through two times of passages (a preceding nozzle and a following nozzle), the threshold value=50% corresponds to 50% of all the pixels constituting one pixel column. On the other hand, in the second embodiment in which one raster line is recorded through four times of passages (the first preceding nozzle, the first following nozzle, the second preceding nozzle and the second following nozzle), the threshold value=50% corresponds to 25% of all the pixels constituting one pixel column. In other words, in the case that one nozzle of plural nozzles used for recording one raster line is the abnormal nozzle, the more the number of the nozzle used for recording the raster line increases, the less the adverse affect (dot omission) caused by the abnormal nozzle decreases in view of the evaluation over the entire raster line. Accordingly, the more the number of nozzle used for recording one raster line increases, the higher the discharge control unit (control unit 11) may increase the threshold value.

As an example, the threshold value may be approximately 40% in the first embodiment, and the threshold value may be approximately 80% in the second embodiment. According to the configuration, in anyone of the first embodiment and the second embodiment, in the case that the pixel of more than approximately 40% (according to the pre-change usage rate) of all the pixels constituting one pixel column is allocated to the abnormal nozzle, the pixel allocated to the other nozzle may be increased to resultantly decrease the dot omission. Of course, one raster line may be recorded through more than four times of passages. In this case, the threshold value may be further increased to the high value.

Others

Each modification examples described above may be combined into any type which are not conflicted with each other though. For example, the entire contents of the first, second, and fourth modification examples are a part of the content of the first recording mode in the third modification example. Further, in the case that the first recording media is used, and in the case that the second recording media is used with the threshold value set to a different value according to a color of ink, furthermore according to a color of ink, the threshold value may be set to a different value. Still furthermore, in the case that the threshold value is set to a different value according to the difference of recording media or the difference of inks, further according to the number of nozzles used for recording one raster line, the threshold value may be set to a different value.

The above descriptions provide the first scheme and the second scheme as a scheme in which in the abnormal nozzle corresponding pixel column, the ratio of the pixel allocated to the other nozzle is increased to a value which is higher than the ratio of the pixel allocated to the abnormal nozzle. However, the first scheme may not be used according to the threshold value. For example, it is assumed that the threshold value is 40%, and the pre-change usage rate of the abnormal nozzle is 40%. In this case, it is possible to meet the condition that the pre-change usage rate of the abnormal nozzle is more than or equal to the threshold. However, in this case, if the first scheme is use to change the pre-change usage rate 40% of the abnormal nozzle and the pre-change usage rate 60% of the other nozzle with each other, it may be difficult to realize the purpose for decreasing the dot omission because the usage rate (the post-change usage rate 40%) of the other nozzle is below the usage rate (post-change usage rate 60%) of the abnormal nozzle. Therefore, in the case that at least a value of less than 50% is applied as the threshold value, the control unit 11 uses the second scheme to assure that the usage rate (post-change usage rate) of the other nozzle becomes above the usage rate (post-change usage rate) of the abnormal nozzle.

What is claimed is:

1. A liquid discharge control apparatus that moves a liquid discharge head having a plurality of nozzles in a predetermined direction, and discharges liquid from the nozzle, the liquid discharge control apparatus comprising:

a discharge control unit that controls the discharge of the liquid through the nozzle, by allocating, to the nozzle, pixels which define a discharge or a non-discharge of the liquid, wherein in the case that the discharge control unit allocates, to a first nozzle, pixels of a first ratio in a pixel column that represents one raster line parallel to the predetermined direction, and allocates, to a second nozzle, pixels of a second ratio in the pixel column, to use the plurality of nozzles which include at least the first nozzle and the second nozzle and record the raster line on recording media, and in the case that one nozzle of the first nozzle and the second nozzle is an abnormal nozzle that has abnormality in the discharge of liquid, and the ratio of the pixel in the pixel column allocated to the one nozzle is more than or equal to a predetermined ratio with respect to a total of the first ratio and the second ratio, the discharge control unit increases the ratio of the pixel in the pixel column allocated to the other nozzle of the first nozzle and the second nozzle, and wherein the discharge control unit selectively performs a first mode and a second mode, the first mode being a mode in which the ratio of the pixel allocated to the other nozzle is increased in the case that the one nozzle is the abnormal nozzle and the ratio of the pixel allocated to the one nozzle is more than or equal to the predetermined ratio with respect to a total of the first ratio and the second ratio, the second mode being a mode in which the ratio of the pixel allocated to the other nozzle is not changed regardless of whether or not the one nozzle is the abnormal nozzle, and the discharge control unit selects one of the first mode and the second mode according to types of images which include the pixel column.

2. The liquid discharge control apparatus according to claim 1, wherein the discharge control unit changes the first ratio and the second ratio with each other to increase the ratio of the pixel allocated to the other nozzle.

3. The liquid discharge control apparatus according to claim 1, wherein the higher a permeability of liquid of the recording media is, the higher the discharge control unit increases the predetermined ratio.

4. The liquid discharge control apparatus according to claim 1, wherein the liquid discharge head can discharge, as the liquid, at least a first ink and a second ink of which density is higher than that of the first ink, and the discharge control unit sets the predetermined ratio used in the case that the first nozzle and the second nozzle are nozzles which discharge the first ink, to a value which is higher than the predetermined ratio used in the case that the first nozzle and the second nozzle are nozzles which discharge the second ink.

5. The liquid discharge control apparatus according to claim 1, wherein the more the number of the nozzles which record one raster line increases, the higher the discharge control unit increases the predetermined ratio.

6. A liquid discharge control method of moving a liquid discharge head having a plurality of nozzles in a predetermined direction, and discharging liquid from the nozzle, the liquid discharge control method comprising:

controlling the discharge of the liquid through the nozzle, by allocating, to the nozzle, pixels which define a discharge or a non-discharge of the liquid, wherein in the case that controlling the discharge of the liquid causes to allocate, to a first nozzle, pixels of a first ratio in a pixel column that represents one raster line parallel to the predetermined direction, and to allocate, to a second nozzle, pixels of a second ratio in the pixel column, to use the plurality of nozzles which include at least the first nozzle and the second nozzle and record the raster line on recording media, and in the case that one nozzle of the first nozzle and the second nozzle is an abnormal nozzle that has abnormality in the discharge of liquid, and the ratio of the pixel in the pixel column allocated to the one nozzle is more than or equal to a predetermined ratio with respect to a total of the first ratio and the second ratio, controlling the discharge of the liquid causes to increase the ratio of the pixel in the pixel column allocated to the other nozzle of the first nozzle and the second nozzle, and wherein the controlling the discharge selectively performs a first mode and a second mode, the first mode being a mode in which the ratio of the pixel allocated to the other nozzle is increased in the case that the one nozzle is the abnormal nozzle and the ratio of the pixel allocated to the one nozzle is more than or equal to the predetermined ratio with respect to a total of the first ratio and the second ratio, the second mode being a mode in which the ratio of the pixel allocated to the other nozzle is not changed regardless of whether or not the one nozzle is the abnormal nozzle, and the controlling the discharge selects one of the first mode and the second mode according to types of images which include the pixel column.

* * * * *